United States Patent [19]

Kitahara et al.

[11] Patent Number: 4,601,273

[45] Date of Patent: Jul. 22, 1986

[54] AIR/FUEL RATIO MONITORING SYSTEM IN IC ENGINE USING OXYGEN SENSOR

[75] Inventors: Tsuyoshi Kitahara, Yokohama, Japan; Kohki Sone, Ann Arbor, Mich.

[73] Assignee: Nissan Motor Co., Ltd., Yokohama, Japan

[21] Appl. No.: 655,225

[22] Filed: Sep. 27, 1984

[30] Foreign Application Priority Data

Sep. 29, 1983 [JP] Japan ..... 58-181397

[51] Int. Cl.[4] ..... F01N 3/20

[52] U.S. Cl. ..... 123/440; 123/489

[58] Field of Search ..... 123/440, 484; 204/195 S, 1 T

[56] References Cited

U.S. PATENT DOCUMENTS

| | | | |
|---|---|---|---|
| 4,157,282 | 6/1979 | Riddel | 204/195 S |
| 4,203,394 | 5/1980 | Aono | 123/440 |
| 4,207,159 | 6/1980 | Kimura | 204/195 S |
| 4,365,604 | 12/1982 | Sone | 123/440 |
| 4,494,374 | 1/1985 | Kitahara | 123/440 |
| 4,502,444 | 3/1985 | Rubbo | 123/440 |

FOREIGN PATENT DOCUMENTS

| | | | |
|---|---|---|---|
| 2115158 | 9/1983 | United Kingdom | 123/440 |

*Primary Examiner*—Ronald B. Cox

*Attorney, Agent, or Firm*—Schwartz, Jeffery, Schwaab, Mack, Blumenthal & Evans

[57] ABSTRACT

An air/fuel ratio monitoring system in an IC engine, using an oxygen sensor of the concentration cell type which has an inner electrode layer, a microscopically porous layer of oxygen ion conductive solid electrolyte, and an outer electrode layer to be exposed to the exhaust gas and exhibits a sharp change in the level of output voltage in response to a change in the air/fuel ratio in the engine across the stoichiometric ratio. To ensure accurate monitoring of the air/fuel ratio even though an average level of the sensor output changes for various reasons such as aging of the sensor, the monitoring system produces a variable reference voltage. The output of the oxygen sensor is compared with this reference voltage by first adding or subtracting a fixed voltage to the output voltage of the sensor, depending on the result of comparison between the sensor output. The resultant reference voltage and voltage is then smoothed in an RC circuit. To prevent misjudgement of the air/fuel ratio by unintentional intersection of the sensor output voltage attenuating after responding to a change in the air/fuel ratio across the stoichiometric ratio and the reference voltage, the system includes a control means for varying the time constant at the voltage-smoothing operation according to the manner of a change in the sensor output voltage.

8 Claims, 8 Drawing Figures

AIR/FUEL RATIO MONITORING SYSTEM IN IC ENGINE USING OXYGEN SENSOR

BACKGROUND OF THE INVENTION

This invention relates to a system for monitoring the air/fuel ratio in an internal combustion engine by using an oxygen sensor of the concentration cell type disposed in the exhaust gas.

In recent automotive internal combustion engines it is common to control the air/fuel mixing ratio precisely to a predetermined optimum value by performing feedback control. In many cases the target value of the air/fuel ratio is a stoichiometric air/fuel ratio. For example, when a so-called three-way catalyst is used in the exhaust system to achieve simultaneous reduction of $NO_x$ and oxidation of CO and HC, the air/fuel ratio must be controlled precisely to the stoichiometric ratio because this catalyst exhibits best conversion efficiencies in an exhaust gas produced by combustion of a stoichiometric air-fuel mixture. In the current feedback control systems, it is therefore usual to produce a feedback signal by sensing changes in the concentration of oxygen in the exhaust gas.

The sensing device which measures concentration in the exhaust gas, thereby monitoring the air/fuel ratio in the engine, usually employs an oxygen sensor of the concentration cell type having a layer of an oxygen ion conductive solid electrolyte, such as zirconia, stabilized by calcia or yttria, and two electrode layers formed on the outer and inner surfaces of the solid electrolyte layer, respectively. An oxygen sensor of this category, suitable for use in a feedback control system which aims at the stoichiometric air/fuel ratio is produced by making both the solid electrolyte layer and the outer electrode layer permeable to gas molecules. When this oxygen sensor is disposed in the exhaust passage of an internal combustion engine with the outer electrode layer exposed to the exhaust gas, an oxygen partial pressure in the exhaust gas always acts on the outer electrode layer. Furthermore, an oxygen partial pressure is produced at the inner electrode layer by reason of inward diffusion of oxygen contained in the exhaust gas through the microscopically porous solid electrolyte layer. However, the oxygen partial pressure at the inner electrode layer does not instantaneously follow a change in the oxygen partial pressure in the exhaust gas since the solid electrolyte layer is relatively low in permeability and offers some resistance to the diffusion of oxygen molecules therethrough. Therefore, when a considerable change is produced in the concentration of oxygen in the exhaust gas by a change in the air/fuel ratio in the engine across the stoichiometric ratio, a great difference arises between the oxygen partial pressure at the outer electrode layer and that at the inner electrode layer. This causes the output voltage of the oxygen sensor to exhibit a sharp change from a high level to a low level, or vice versa. Such a change in the output voltage of the oxygen sensor can easily be detected by continuously comparing the sensor output voltage with a suitably predetermined reference voltage.

However, under some conditions the accuracy of the air/fuel ratio monitoring by the above described method is not reliable. For example, during operation of the engine under transitional conditions there is the possibility of a considerable rise or fall in an average level of the output voltage of the oxygen sensor, whereas the aforementioned reference voltage remains unchanged. This leads to the possibility that the output voltage of the oxygen sensor does not intersect the reference voltage even though the actual air/fuel ratio changes across the stoichiometric ratio, so that the air/fuel ratio is misjudged. Furthermore, a change in an average level of the oxygen sensor output voltage is probable as the oxygen sensor is used for a long time.

To solve the above described problem, Japanese patent application primary publication No. 58-144649 and corresponding British patent application publication No. 2,115,158A propose an air/fuel ratio monitoring system, in which the reference voltage with which the output of the oxygen sensor is compared is made variable depending on the level of the oxygen sensor output voltage. That is, the reference voltage is produced by first producing a variable voltage signal. The variable voltage signal is obtained by adding or subtracting a fixed voltage value to the oxygen sensor output when the sensor output indicates that the air/fuel ratio is above or below the stoichiometric ratio, respectively. The variable voltage signal is smoothed in an RC circuit to a variable reference voltage. The time constant of the RC circuit is set at a fairly large value so that, when the oxygen sensor output voltage steeply varies in response to a change in the air/fuel ratio across the stoichiometric ratio, the reference voltage varies at a lower rate than the sensor output voltage to ensure that the varying sensor output voltage intersects the reference voltage. This air/fuel ratio monitoring system is certainly improved in accuracy. However, when the attenuation of the sensor output voltage due to a gradual change in the oxygen partial pressure at the inner electrode of the oxygen sensor takes place at a relatively high rate, the attenuating sensor output voltage may intersect the reference voltage which is varying at a relatively low rate. Then, the system will incorrectly indicate that the air/fuel ratio has crossed the stoichiometric ratio.

SUMMARY OF THE INVENTION

It is an object of the present invention to provide an improved system for monitoring the air/fuel ratio in an internal combustion engine as the basis of feedback control of the air/fuel ratio. This is accomplished by using an oxygen sensor of the above described concentration cell type responsive to a change in the air/fuel ratio across the stoichiometric ratio. The output voltage of the oxygen sensor is compared with a reference voltage which is automatically varied according to changes in the sensor voltage, so that the air/fuel ratio is accurately monitored.

A system according to the invention monitoring the air/fuel ratio of an air-fuel mixture supplied to an internal combustion engine. The system includes an oxygen sensor of the concentration cell type, which is disposed in the exhaust passage of the engine and has a laminate of an inner electrode layer, a microscopically porous layer of an oxygen ion conductive solid electrolyte, and an outer electrode layer exposed to the exhaust gas. The oxygen sensor produces a high-level voltage signal output when the air/fuel ratio of the air-fuel mixture is below the stoichiometric ratio similarly, low-level voltage signal is produced when the air/fuel ratio is above the stoichiometric ratio. Further, the system includes a judgement means for producing an air/fuel ratio signal which indicates whether the air/fuel ratio is above or below the stoichiometric ratio by comparing the output of the oxygen sensor with a reference voltage. Additionally, a modulating means produces a modulated voltage signal by subtracting a first fixed voltage from the output of the oxygen sensor when the air/fuel ratio signal indicates that the air/fuel ratio is below the stoichiometric ratio and by adding a second definite voltage to the output of the oxygen sensor when the air/fuel ratio signal indicates that the air/fuel ratio is above the stoichiometric ratio an RC circuit is used for smoothing the modulated voltage signal to produce a smoothed voltage and for supplying the smoothed voltage to the judgement means as the reference voltage. The smoothing means is made such that the time constant of the smoothing is variable. The system further comprises a control means for varying the time constant of the smoothing means according to the manner of a change in the output of the oxygen sensor.

As a preferred example, the control means according to the invention comprises differentiating means for differentiating the output of the oxygen sensor and logic means. This permits setting the time constant of the smoothing means at a relatively small first value when the differential value of the oxygen sensor output is within a predetermined range and at a relatively large second value when the differential value of the oxygen sensor output is outside the predetermined range.

In the system according to the invention, the reference voltage is automatically varied so as to rise and fall as the level of the oxygen sensor output rises and falls. Accordingly, a comparison between the sensor output voltage and the reference voltage can be easily achieved and, hence, accurate monitoring of the air/fuel ratio can be made even if an average level of the oxygen sensor output changes because of aging of the oxygen sensor, for example. Furthermore, the time constant at the voltage-smoothing operation in producing the reference voltage is automatically varied in a suitable relation to the manner of a change in the output of the oxygen sensor, so that the rate of a change in the reference voltage can be made relatively high while the oxygen sensor output is attenuating after responding to a change in the air/fuel ratio across the stoichiometric ratio. Thus, an incorrect measurement of the air/fuel ratio by intersection of the attenuating sensor output and the reference voltage is eliminated.

DETAILED DESCRIPTION OF THE INVENTION

Figure 1:
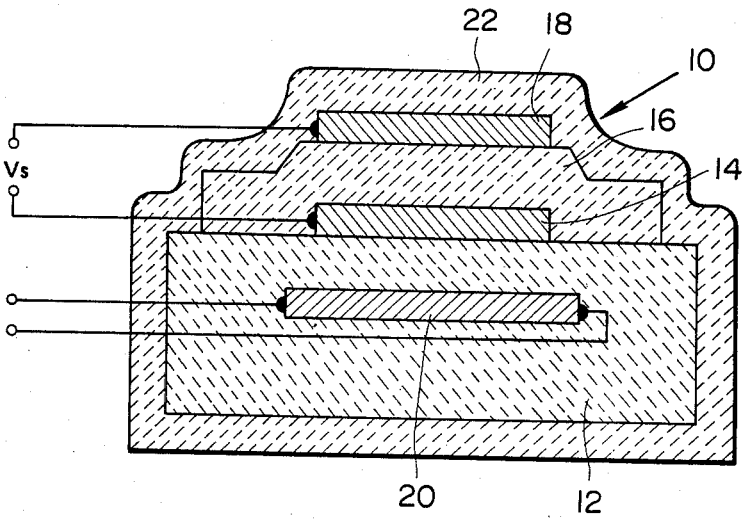
FIG. 1 is an explanatory sectional view of an oxygen sensor used in the present invention.

FIG. 1 shows an exemplary construction of an oxygen snesor 10 used in the present invention.

A structurally basic member of this sensor 10 is a plate-shaped substrate 12 made of a ceramic material such as alumina. The sensitive part of the oxygen sensor 10 takes the form of a laminate of thin layers supported on the ceramic substrate 12. The laminate consists of an inner electrode layer 14, which is often called a reference electrode, formed on the outer surface of the substrate 12, a layer 16 of an oxygen ion conductive solid electrolyte, such as zirconia, containing a small amount of a stabilizing oxide, such as yttria or calcia, formed on the inner electrode layer 14 so as to substantially cover the entire electrode layer 14 and peripherally come into direct contact with the upper surface of the substrate 12, and an outer electrode layer 18, which is often called a measurement electrode, formed on the upper surface of the solid electrolyte layer 16. Both the outer electrode layer 18 and the solid electrolyte layer 16 are microscopically porous and permeable to gas molecules. Each of these three layers 14, 16, 18 can be formed by a conventional thick-film technique. A heater 20 in the form of either a thin layer or a thin wire of a suitably resistive metal is embedded in the substrate 12, because the solid electrolyte 16 hardly exhibits its activity at temperatures below a certain level, approximately 400° C. The outer surfaces of the oxygen sensor 10 are coated with a porous protective layer 22 which is formed of a ceramic material.

Figure 2:
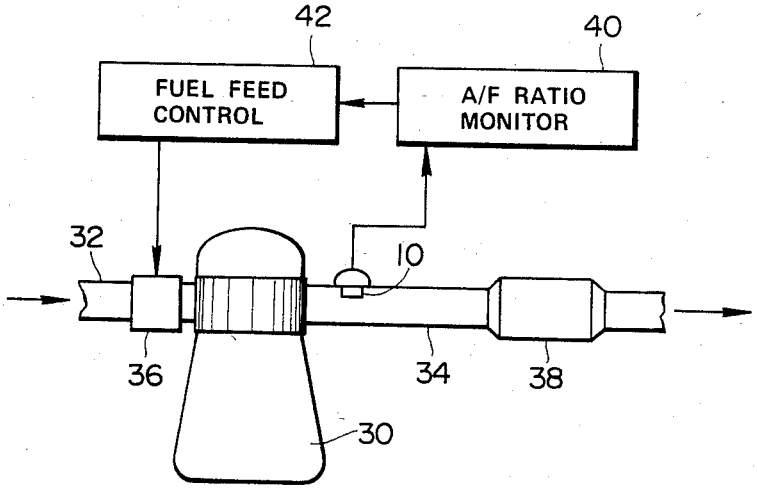
FIG. 2 is a diagrammatic illustration of an internal combustion engine system including an air/fuel ratio monitoring system according to the invention.

In FIG. 2, reference numeral 30 indicates an automotive internal combustion engine provided with an intake passage 32 and an exhaust passage 34. Numeral 36 indicates an electrically controlled fuel-supplying device such as electronically controlled fuel injection valves. Numeral 38 indicates a catalytic converter which occupies a section of the exhaust passage 34 and contains a conventional three-way catalyst for example.

To perform feedback control of the fuel-supplying device 36 with the aim of supplying an optimum air-fuel mixture, in this case a stoichiometric mixture, to the engine 30 during its normal operation to thereby allow the catalyst in the converter 38 to exhibit best conversion efficiencies, the oxygen sensor 10 of FIG. 1 is disposed in the exhaust passage 34 at a section upstream of the catalytic converter 38. The oxygen sensor 10 serves as a probe to detect deviations of actual air/fuel ratio in the engine 30 from the intended stoichiometric air/fuel ratio by sensing changes in the concentration of oxygen in the exhaust gas. Using the output of the oxygen sensor 10, an air/fuel ratio monitoring circuit 40 produces an air/fuel ratio signal which indicates whether the actual air/fuel ratio in the engine 30 is above or below the desired stoichiometric air/fuel ratio. A fuel feed control unit 42 receives the air/fuel ratio signal and controls the operation of the fuel-supplying device 36 so as to correct the detected deviations of the air/fuel ratio.

The oxygen sensor 10 of FIG. 1 operates on the principle of an oxygen concentration cell. In the exhaust passage 34 in the engine system of FIG. 2, the exhaust gas easily permeates through the porous protective layer 22 of the oxygen sensor 10 and arrives at the outer electrode layer 18 of the sensor 10. Then a portion of the exhaust gas further diffuses inward through the micropores in the solid electrolyte layer 16, but it takes some time for the exhaust gas to arrive at the inner electrode layer 14 across the solid electrolyte layer 16 because of relatively low permeability of the solid electrolyte layer 16 compared with the protective coating layer 22.

Figure 3:
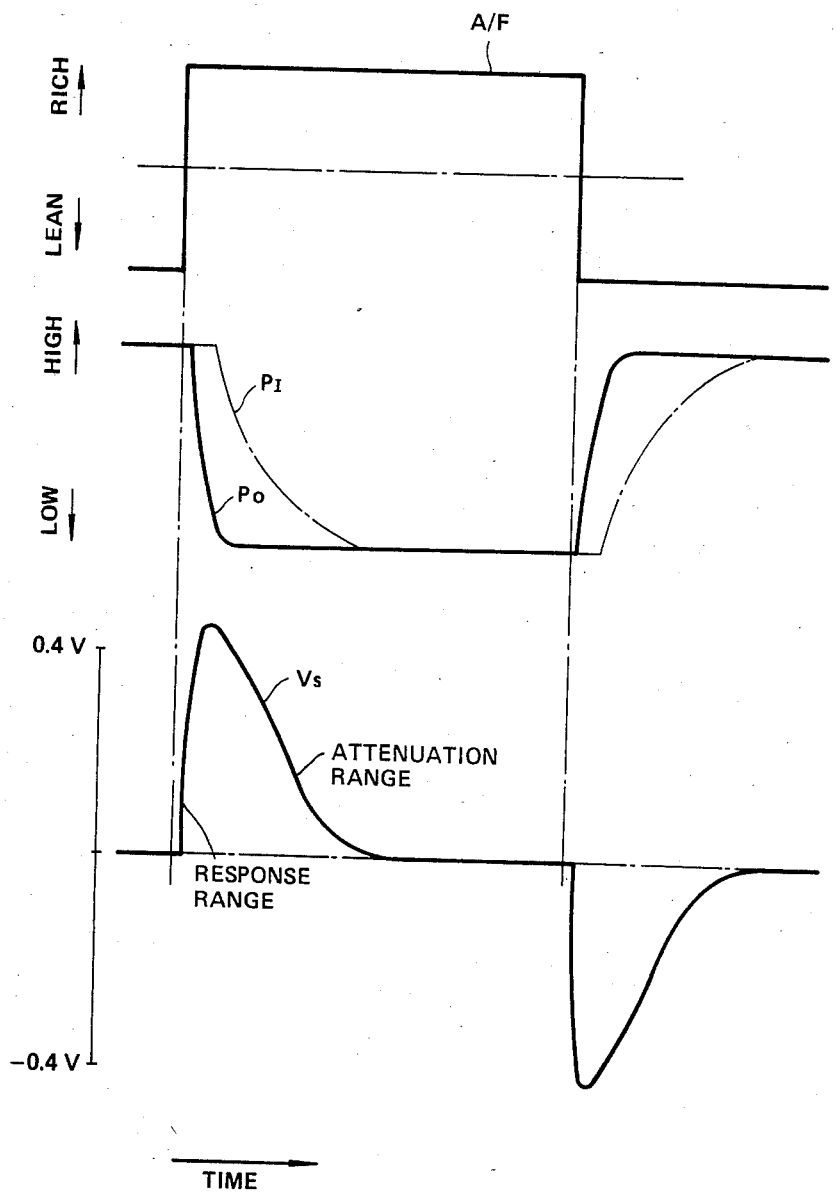
FIG. 3 is a chart showing the manner of function of the oxygen sensor of FIG. 1 disposed in exhaust gases of an internal combustion engine.

Referring to FIG. 3, the actual air/fuel ratio or the content of fuel in the air-fuel mixture supplied to the engine 30 will periodically vary in the manner as represented by curve A/F since the air/fuel ratio is under feedback control with the aim of the stoichiometric air/fuel ratio. When the air/fuel ratio in the engine 30 shifts from the fuel-lean side to the fuel-rich side across the stoichiometric ratio, there is a sharp decrease in the oxygen partial pressure in the exhaust gas. Since the protective coating layer 22 of the oxygen sensor 10 is high in permeability, an oxygen partial pressure $P_O$ at the outer electrode layer 18 of the sensor 10 undergoes a sharp decrease similar to the oxygen partial pressure in the exhaust gas flowing around the sensor 10. However, an oxygen partial pressure $P_I$ at the inner electrode layer 14 undergoes a more gradual decrease because of a relatively low rate of diffusion of the exhaust gas through the solid electrolyte layer 16 which is lower in permeability than the outer coating layer 22. Accordingly, a difference arises between the oxygen partial pressure $P_O$ at the outer electrode layer 18 and the oxygen partial pressure $P_I$ at the inner electrode layer 14, and therefore the oxygen sensor 10 generates an electromotive force E across the solid electrolyte layer 16. The magnitude of this electromotive force E is given by the Nernst's equation:

$$E=(RT/4F)\log_e(P_I/P_O)$$

where R is the gas constant, F is the Farady constant, and T represents absolute temperature.

An output voltage $V_s$ of the oxygen sensor 10 measured between the inner and outer electrodes 14 and 18 can be regarded as to be approximately equal to the electromotive force E. As shown in FIG. 3 wherein the curve A/F represents the content of fuel in an air-fuel mixture actually supplied to the engine 30, the output voltage $V_S$ of the oxygen sensor 10 exhibits a sharp rise to the positive side in response to a change in the air/fuel ratio in the engine across the stoichiometric ratio from the fuel-lean side to the fuel-rich side and a sharp drop to the negative side in response to a reverse change in the air/fuel ratio.

In the oxygen sensor 10, an oxygen partial pressure $P_O$ at the outer electrode layer 18 is always nearly equal to a variable oxygen partial pressure in the exhaust gas, whereas an oxygen partial pressure $P_I$ at the inner electrode layer 14 is regarded as a mean partial pressure of oxygen in the exhaust gas with respect to time. The output voltage $V_S$ of the oxygen sensor 10 represents the instantaneous difference between the oxygen partial pressure $P_O$ and the oxygen partial pressure $P_I$ and accordingly the waveform of the sensor output voltage $V_S$ is shown in FIG. 3 when the air/fuel ratio in the engine undergoes periodic changes across the stoichiometric ratio. In this waveform, the steeply rising or dropping range which appears in response to a sudden change in the air/fuel ratio is called a response range, and the gently varying range which represents a gradual change in the oxygen partial pressure $P_I$ is called an attenuation range.

Figure 4:
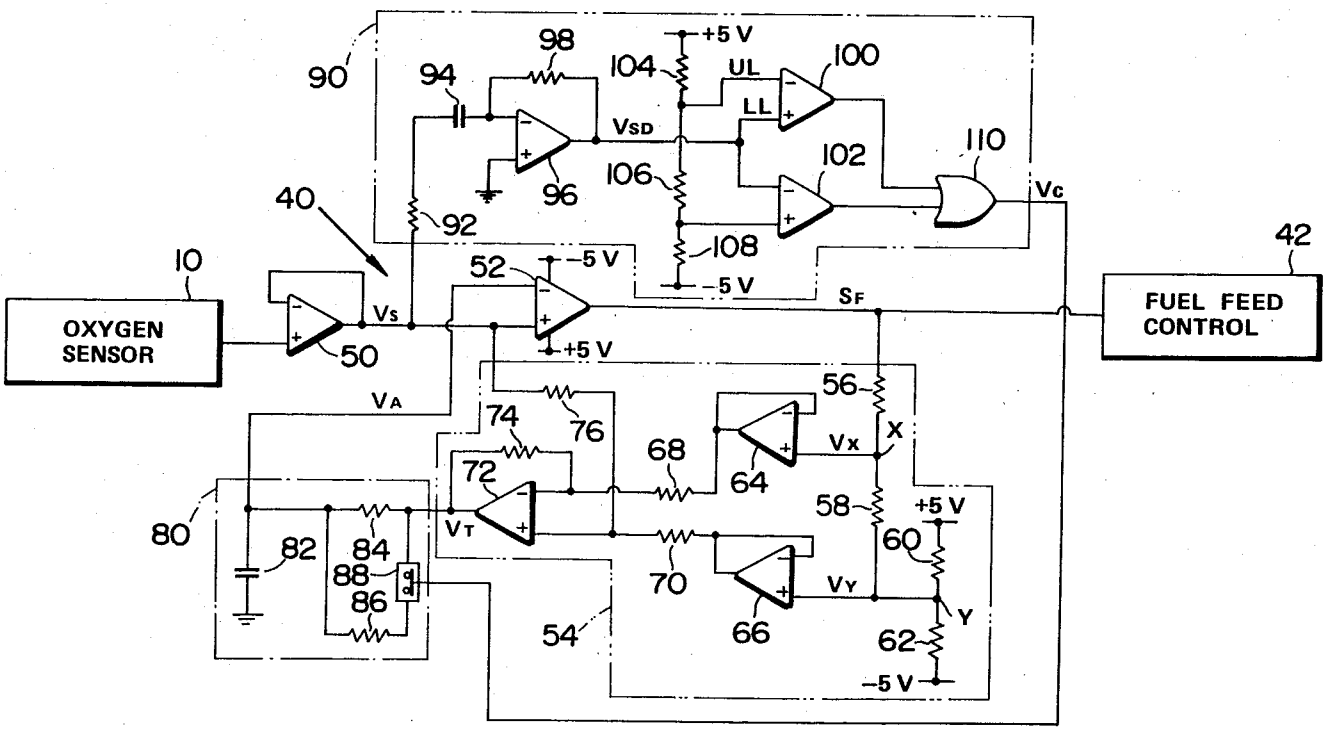
FIG. 4 is a circuit diagram showing an air/fuel ratio monitoring system embodying the present invention.

FIG. 4 shows the construction of the air/fuel ratio monitoring circuit 40 in FIG. 2 as an embodiment of the present invention.

In this circuit, the output voltage $V_S$ of the oxygen sensor 10 is applied to a positive terminal of a comparator 52 via a buffer amplifier 50 of which the amplification factor is 1:1. At a negative terminal the comparator 52 receives a reference voltage signal $V_A$, which is produced in this circuit in the manner described hereinafter. The comparator 52 outputs an air/fuel ratio signal $S_F$ which indicates the results of a comparison between the sensor output voltage $V_S$ and the reference voltage $V_A$. That is, the signal $S_F$ is a two-level voltage signal which becomes a high-level signal (e.g. +5 V) and indicates the feed of a fuel-rich mixture to the engine 30 when $V_S>V_A$ and a low-level signal (e.g. −5 V) and indicates the feed of a fuel-lean mixture to the engine when $V_S \leqq V_A$. The air/fuel ratio signal $S_F$ is supplied to the fuel feed control unit 42 as mentioned hereinbefore.

The circuit of FIG. 4 includes an arithmetic circuit 54 and a smoothing circuit 80 to produce the aforementioned reference voltage $V_A$ by using the sensor output voltage $V_S$ and the air/fuel ratio signal $S_F$.

In the arithmetic circuit 54, there are four resistors 56, 58, 60 and 62 arranged in the illustrated manner in order to divide the voltage signal $S_F$ and a constant voltage (+5 V)−(−5 V). A voltage $V_X$ at the junction between the two resistors 56 and 58 is applied to a negative input terminal of an operational amplifier 72 of the negative feedback type via a buffer amplifier 64 and a resistor 68, and another voltage $V_Y$ at the junction between the resistors 60 and 62 is applied to the positive input terminal of the operational amplifier 72 via a buffer amplifier 66 and a resistor 70. Numeral 74 indicates a feedback resistor connected with the operational amplifier 72. In addition, the output voltage $V_S$ of the oxygen sensor 10 is applied to the positive input terminal of the operational amplifier 72 via a resistor 76.

The voltage $V_X$ and the voltage $V_Y$ are both variable depending on the level of the air/fuel ratio signal $S_F$. When the air/fuel ratio signal $S_F$ is a high-level signal indicative of the feed of a rich mixture to the engine the voltage $V_X$ takes a value $V_{XR}$ and the voltage $V_Y$ a value $V_{YR}$. When the signal $S_F$ is a low-level signal indicative of the feed of a lean mixture to the engine the voltage $V_X$ takes a value $V_{XL}$ and the voltage $V_Y$ a value $V_{YL}$. The relations between these voltage values are as follows.

$$V_{XR}>V_{YR}>V_{YL}>V_{XL}$$

The operational amplifier 72 serves as an adder which produces an output voltage $V_T$ by adding a voltage determined by the difference between the voltages $V_Y$ and $V_X$ to the sensor output voltage $V_S$. This voltage $V_T$ is the output of the arithmetic circuit 54. When the air/fuel ratio signal $S_F$ is a high-level signal indicative of a fuel-rich condition, $$V_T=V_S+(V_{YR}-V_{XR})$$

When the signal $S_F$ is a low-level signal indicative of a fuel-lean condition, $$V_T=V_S+(V_{YL}-V_{XL})$$

The resistances of the four resistors 56, 58, 60 and 62, are determined such that each of $(V_{YR}-V_{XR})$ and ($V_{YL}-V_{XL}$) becomes an adequate constant. For example, ($V_{YR}-V_{XR}$)=−0.4 V, and ($V_{YL}-V_{XL}$)=0.4 V. In other words, the output voltage $V_T$ is given by subtracting a definite voltage $V_R$ from the sensor output voltage $V_S$, $V_T=V_S+(-V_R)=V_S-V_R$, while the signal $S_F$ is a high-level signal indicative of a fuel-rich condition and by adding a definite voltage $V_L$ to the sensor output voltage $V_S$, $V_T=V_S+V_L$, when the signal $S_F$ is a low-level signal indicative of a fuel-lean condition.

The smoothing circuit 80 has a capacitor 82 which is connected to the output terminal of the operational amplifier 72 via a resistor 84. Another resistor 86 is connected in parallel with the resistor 84, and a relay 88 is interposed between the resistor 86 and the operational amplifier 72. The relay 88 serves the purpose of varying the time constant of the smoothing circuit 80. The time constant takes a relatively small first value $\tau_1$ when the relay 88 is in the closed state and a relatively large second value $\tau_2$ when the relay 88 is in the open state. There is a time constant controlling circuit 90 which provides a two-level voltage signal $V_C$ to the smoothing circuit 80. The relay 88 opens when the signal $V_C$ is a high-level signal as will be described hereinafter. The output voltage $V_T$ of the arithmetic circuit 54, i.e. either $V_S-V_R$ or $V_S-V_L$, is smoothed to a voltage $V_A$ which is gradually varying in dependence on the output voltage $V_S$ of the oxygen sensor 10. The smoothed voltage $V_A$ is supplied to the comparator 52 as the reference voltage with which the sensor output voltage $V_S$ is compared.

The time constant controlling circuit 90 has an operational amplifier 96 with a feedback resistor 98 connected thereto, and the output voltage $V_S$ of the oxygen sensor 10 is applied to the negative input terminal of the operational amplifier 96 via a resistor 92 and a capacitor 94. The capacitor 94, operational amplifier 96 and resistor 98 constitute a differentiation circuit, which produces a differential signal $V_{SD}$ by differentiating the sensor output voltage $V_S$ with respect to time. The time constant controlling circuit 90 is constructed so as to examine whether the magnitude of the differential signal $V_{SD}$ is within a predetermined range or not and to output a high-level signal as the aforementioned signal $V_C$ when the magnitude of the differential signal $V_{SD}$ is outside the predetermined range. The differential signal $V_{SD}$ is applied to a positive input terminal of a first comparator 100 and also to a negative input terminal of a second comparator 102. Using a constant voltage and voltage dividing resistors 104, 106 and 108, a voltage UL indicative of the upper boundary of the aforementioned predetermined range is supplied to the first comparator 100 and another voltage LL indicative of the lower boundary of the same range to the second comparator 102. The outputs of the two comparators 100 and 102 are supplied to an OR-gate 110. The output of the OR-gate 110 is the relay control signal $V_C$.

When the output $V_S$ of the oxygen sensor 10 is in the aforementioned attenuation range, or remains nearly constant around 0 volts, the differential voltage signal $V_{SD}$ is within the predetermined range, $LL<V_{SD}<UL$. Then the output $V_C$ of the OR-gate 110 becomes a low-level signal, which allows the relay 88 in the smoothing circuit 80 to remain closed. Accordingly the time constant of this circuit 80 takes the smaller value $\tau_1$. When the sensor output $V_S$ is in the aforementioned response range, the differential voltage signal $V_{SD}$ becomes outside the predetermined range, $LL\geqq V_{SD}$ or $V_{SD}\geqq UL$. Then the output $V_C$ of the OR-gate 110 becomes a high-level signal which causes the relay 88 to open to thereby disconnect the resistor 86. Accordingly, the time constant of the smoothing circuit 80 takes the larger value $\tau_2$.

Prior to the description of the function of the circuit of FIG. 4, a brief description will be made about an air/fuel ratio monitoring circuit disclosed in GB No. 2,115,158A mentioned hereinbefore.

Figure 5:
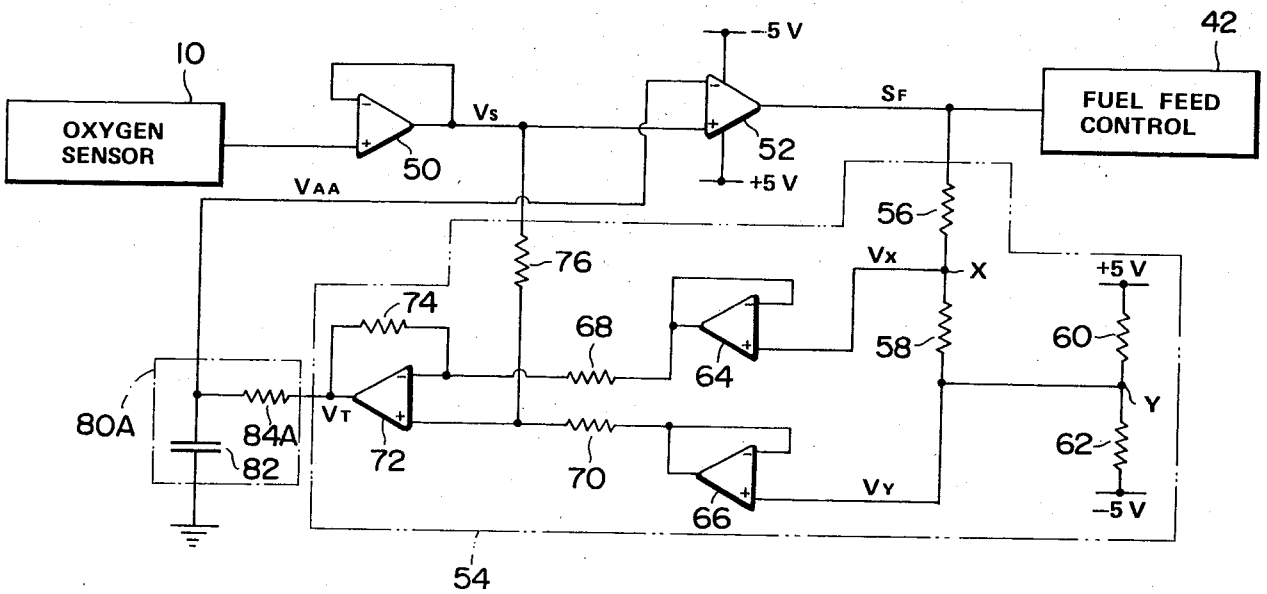
FIG. 5 (PRIOR ART)
FIG. 5 is a circuit diagram showing an air/fuel ratio monitoring system proposed heretofore.

FIG. 5 shows the air/fuel ratio monitoring circuit, according to GB No. 2,115,158A. In this circuit the comparator 52 which produces the air/fuel ratio signal $S_F$, and the arithmetic circuit 54 are identical with the counterparts of the circuit of FIG. 4. However, the smoothing circuit 80A in FIG. 5 differs from the smoothing circuit 80 in FIG. 4, in that the capacitor 82 in the smoothing circuit 80A is always connected to the output terminal of the arithmetic circuit 54 via a single fixed resistor 84A, so that the time constant of the smoothing circuit 80A is constant. Accordingly, the air/fuel ratio monitoring circuit of FIG. 5 does not include the time constant controlling circuit 90 of FIG. 4 or any alternative thereto.

Figure 6:
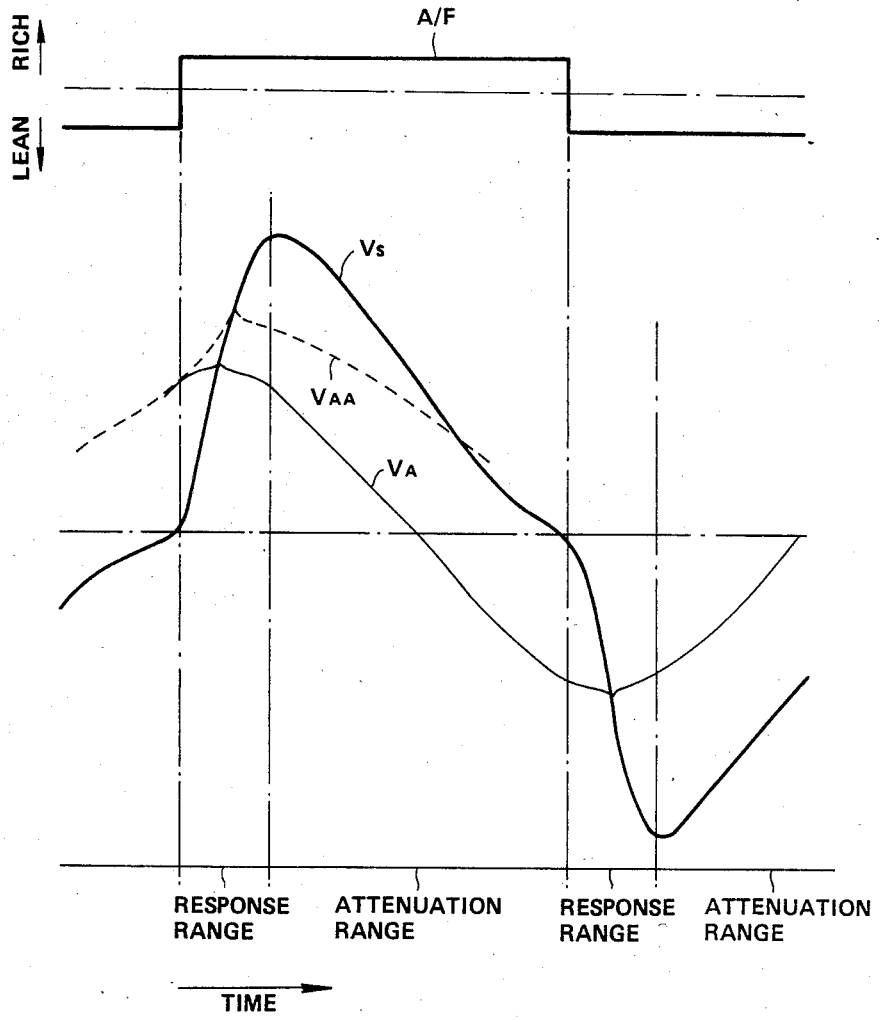
FIG. 6 is a chart showing the manner of function of the air/fuel ratio monitoring system of FIG. 4 in comparison with the function of the known system of FIG. 5.

In the smoothing circuit 80A of FIG. 5, the output voltage $V_T$ of the arithmetic circuit 54, i.e. either $V_S-V_R$ or $V_S+V_L$, is smoothed to a voltage $V_{AA}$, which is supplied to the comparator 52 as the reference voltage. Depending on the operating conditions of the engine or some other factors, the absolute valve of the high-level and/or the low-level of the output voltage $V_S$ of the oxygen sensor 10 varies considerably. In response, the reference voltage $V_{AA}$ rises and falls in accordance with the sensor output voltage $V_S$, as reference voltage $V_{AA}$ is produced by adding a fixed voltage to, or substracting a fixed voltage from, the sensor output voltage $V_S$. Therefore, it is possible to accurately examine whether the actual air/fuel ratio in the engine is above or below the intended stoichiometric ratio even though the sensor output voltage $V_S$ undergoes a change in its standard level or in its waveform. However, the invariable time constant of the smoothing circuit 80A offers a problem when the rate of attenuation of the sensor output voltage $V_S$ after responding to a change in the air/fuel ratio is relatively high. In FIG. 6, the curve in the broken line represents the manner of a change in the reference voltage $V_{AA}$ in the prior art circuit of FIG. 5. The time constant of the smoothing circuit 80A is set at a relatively large value so that the sensor output voltage $V_S$ may intersect the reference voltage $V_{AA}$ within the response range of the sensor output waveform when the air/fuel ratio changes across the stoichiometric ratio. In the attenuation range of the sensor output waveform, there is a possibility that the attenuating sensor output voltage $V_S$ intersects the reference voltage $V_{AA}$ when the rate of attenuation is so high that the reference voltage $V_{AA}$ which is governed by the large time constant cannot follow the rapid attenuation of the sensor output voltage $V_S$. If the sensor output voltage $V_S$ in the attenuation range intersects the reference voltage $V_{AA}$, the comparator 52 will vary the level of the air/fuel signal $S_F$ as if the actual air/fuel ratio had changed across the stoichiometric ratio. This results in faulty feedback control of the air/fuel ratio.

In the air/fuel ratio monitoring circuit according to the invention shown in FIG. 4, the output $V_C$ of the time constant controlling circuit 90 causes the time constant of the smoothing circuit 80 to take the larger value $\tau_2$ by disconnecting of the resistor 86 when the sensor output voltage $V_S$ is in the response range. This time constant value $\tau_2$ is nearly equal to the time constant of the smoothing circuit 80A of FIG. 5. Accordingly, the reference voltage $V_A$ does not follow the steeply changing sensor output voltage $V_S$, and therefore the sensor output voltage $V_S$ in the response range intersects the reference voltage $V_A$. Then, the comparator 52 makes a judgement that the air/fuel ratio has changed, for example, from the lean side to the rich side. In the attenuation range of the sensor output voltage $V_S$, the relay 88 in the smoothing circuit 80 resumes the closed state to cause the time constant of this circuit 80 to take the smaller value $\tau_1$. Accordingly, the reference voltage $V_A$ changes relatively rapidly and can follow the attenuating sensor output voltage $V_S$ even though the rate of attenuation is relatively high. Therefore, the sensor output voltage $V_S$ in the attenuation range never intersects the reference voltage $V_A$, and thus the comparator 52 does not change the level of the air/fuel ratio signal $S_F$ without an actual change in the air/fuel ratio across the stoichiometric ratio. The same holds also when the air/fuel ratio changes from the lean side to the rich side. Thus, the circuit of FIG. 4 always performs accurate monitoring of the air/fuel ratio as the basis of the feedback control of the air/fuel ratio.

Figure 7:
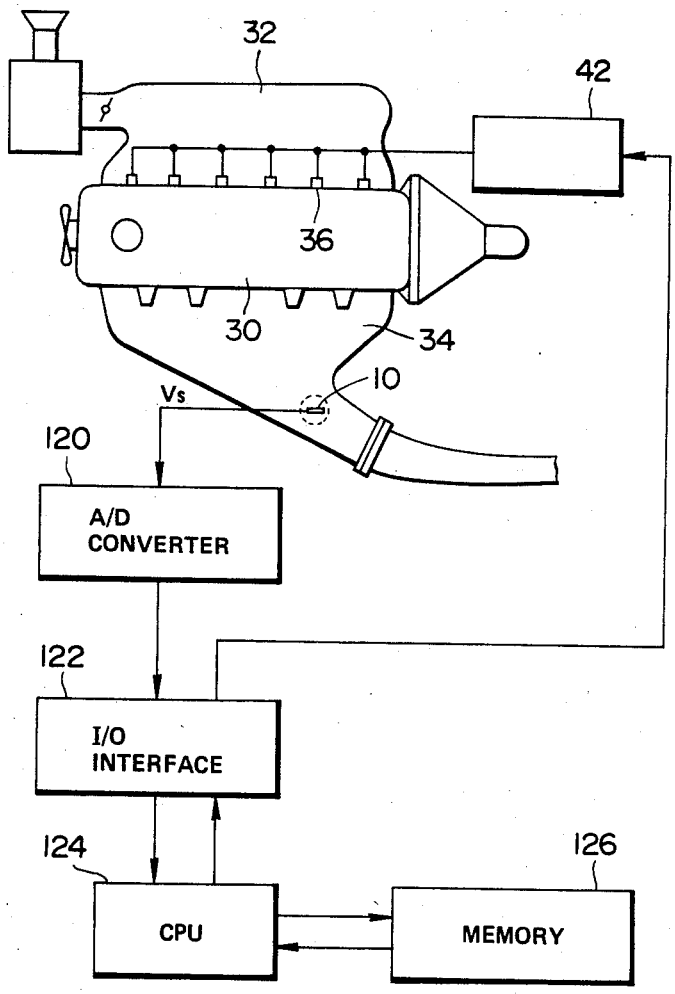
FIG. 7 is a diagrammatic illustration of an internal combustion engine system including an air/fuel ratio monitoring system of digital type according to the invention.
Figure 8:
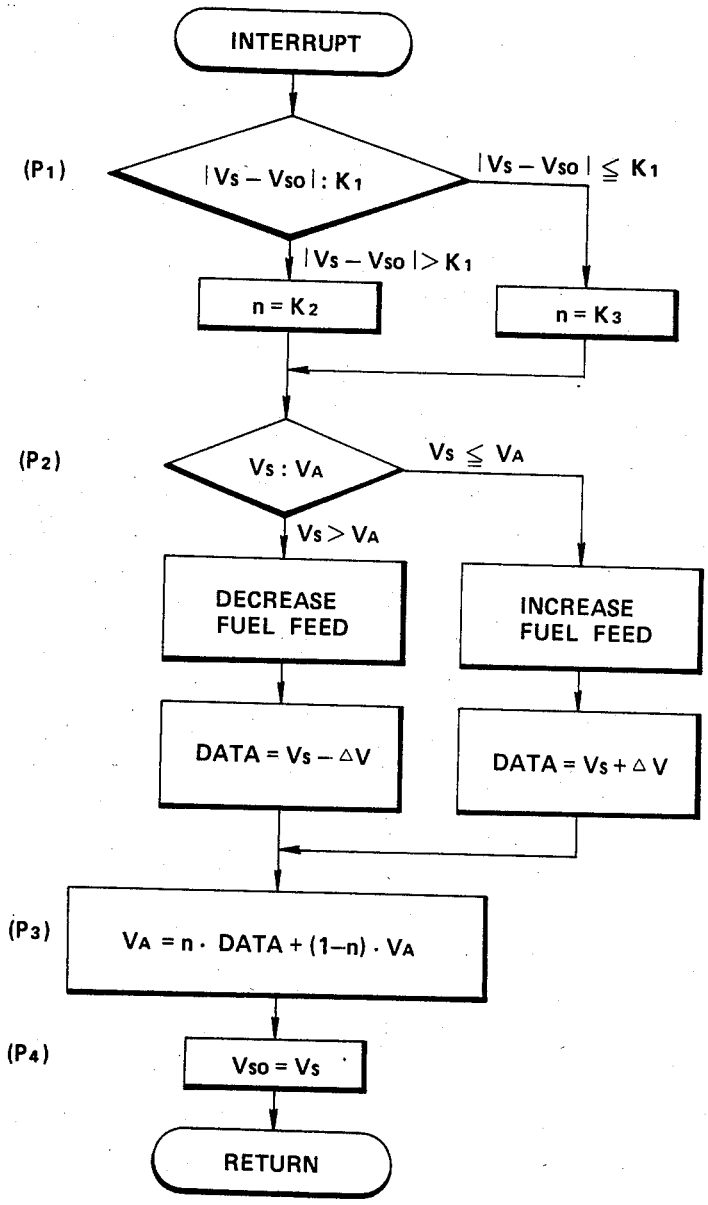
FIG. 8 is a flow chart showing the function of the digital air/fuel ratio monitoring system in FIG. 7.

FIGS. 7 and 8 illustrate another embodiment of the invention, which is a digital system using a microcomputer and serves substantially the same function as the analog circuit of FIG. 4.

In FIG. 7, the output voltage of the oxygen sensor 10 disposed in the exhaust passage or exhaust manifold 34 of the engine 30 is converted into a digital signal in an analog-to-digital converter 120 and supplied to a central processing unit 124 of a microcomputer through an input-output interface 122. The CPU 124 executes a series of commands preprogramed in a memory unit 126 to determine the value of the reference voltage $V_A$ and to make a judgement from the relation between the sensor output voltage $V_S$ and the reference voltage $V_A$ whether the actual air/fuel ratio is above or below the stoichiometric ratio.

More particularly, the microcomputer periodically executes the routine shown as a flow chart in FIG. 8 at predetermined time intervals or alternatively once per predetermined revolutions of the engine.

At step $P_1$, first a difference between the oxygen sensor output voltage $V_S$ at that moment and the value $V_{SO}$ of the oxygen sensor output voltage at the last execution of the same routine is calculated, and then a comparison is made between the absolute value of the calculated difference and a constant $k_1$ which was determined correspondingly to a specified rate of change in the sensor output voltage $V_S$. If $|V_S-V_{SO}|>k_1$ then the value of a variable n is set at a constant $k_2$ which is larger than 0 and smaller than 1. If $|V_S-V_{SO}|\leqq k_1$ then the value of n is set at another constant $k_3$ which is larger than $k_2$ and smaller than 1. That is, the operations at step $P_1$ are first, determining a differential coefficient of the sensor output voltage $V_S$ and next selecting a constant n (i.e. $k_2$ or $k_3$, $0<n<1$) according to the value of the differential coefficient. This constant n determines the rate of response of the reference voltage $V_A$ to a change in the oxygen sensor output voltage $V_S$ and accordingly serves the function of the time constant of an RC circuit.

At step $P_2$, a comparison is made between the sensor output voltage $V_S$ and the reference voltage $V_A$. If $V_S>V_A$ then the CPU 124 commands the fuel feed control unit 42 to decrease the feed of fuel, and the value of a variable DATA, which corresponds to the output $V_T$ of the arithmetic circuit 54 of FIG. 4, is set at $V_S-\Delta V$. If $V_S\leqq V_A$ then the CPU 124 commands the fuel feed control unit 42 to increase the feed of fuel, and the value of DATA is set at $V_S+\Delta V$.

At step $P_3$, the value of the reference voltage $V_A$ is changed to $n\cdot DATA+(1-n)\cdot V_A$. At step $P_4$, the value of the aforementioned variable $V_{SO}$ is set at the instant value of the oxygen sensor output voltage $V_S$. The operation at step $P_3$ is calculating a weighted average of $V_A$ and DATA thereby smoothing the voltage-representing variable DATA produced at step $P_2$ to the new reference voltage value. Since the weighting coefficient n at the weighted averaging is varied depending on the differential coefficient of the sensor output voltage $V_S$, the operation at step $P_3$ corresponds to smoothing of a voltage by an RC circuit of which the time constant is variable. A relatively large value of the differential coefficient of the sensor output voltage $V_S$ indicates that the sensor output voltage $V_S$ is in the response range. In that case the rate of change in the reference voltage $V_A$ is made lower than the rate of change in the sensor output voltage $V_S$. When the differential coefficient of the sensor output voltage $V_S$ is relatively small, it is understood that the sensor output voltage $V_S$ is in the attenuation range, so that the rate of change in the reference voltage $V_A$ is made nearly equal to or higher than the rate of change in the sensor output voltage $V_S$. Therefore, always the air/fuel ratio is accurately monitored without making an erroneous judgement for the reasons described hereinbefore with respect to the analog system of FIG. 4.

The foregoing description of the present invention is provided for the purpose of illustrating the invention and is not considered to be limitative thereof. Clearly, numerous additions, substitutions and other modifications can be made without departing from the scope of the invention as set forth in the appended claims.

What is claimed is:

1. A system for monitoring the air/fuel ratio of an air-fuel mixture supplied to an internal combustion engine, said system comprising:

a concentration cell type oxygen sensor means disposed in an exhaust passage of the engine, said oxygen sensor having a laminate of an inner electrode layer, a microscopically porous layer of an oxygen ion conductive solid electrolyte, and an outer electrode layer exposed to exhaust gas, said sensor means producing an output which becomes a high-level voltage signal when the air/fuel ratio is below the stoichiometric ratio of said air-fuel mixture, and which becomes a low-level voltage signal when the air/fuel ratio is above said stoichiometric ratio;

judgement means for producing an air/fuel ratio signal which indicates whether the air/fuel ratio is above or below said stoichiometric ratio by comparing said output of said oxygen sensor with a reference voltage;

modulating means for producing a modulated voltage signal by subtracting a first fixed voltage from said output of said oxygen sensor when said air/fuel ratio signal indicates that the air/fuel ratio is below said stiochiometric ratio and by adding a fixed definite voltage to said output of said oxygen sensor when said air/fuel ratio signal indicates that the air/fuel ratio is above said stoichiometric ratio; and smoothing means, having a variable time constant, for smoothing said modulated voltage signal to thereby produce a smoothed voltage and for supplying said smoothed voltage to said judgement means as said reference voltage;

control means for varying the time constant of said smoothing means as a function of a change in said output of said oxygen sensor.

2. A method for monitoring the air/fuel ratio of an air-fuel mixture supplied to an internal combustion engine, comprising steps of:

(a) sensing the level of oxygen in an exhaust passage of the engine;

(b) producing an output signal which is a first voltage level when said oxygen level indicates an air/fuel ratio below the stoichiometric ratio of the air-fuel mixture, and which is a second voltage level when the air/fuel ratio is above the stoichiometric ratio of said air-fuel mixture;

(c) comparing said output signal with a reference voltage;

(d) producing an air/fuel ratio signal, responsive to said comparison, indicating whether the air/fuel ratio is above or below the stoichiometric ratio;

(e) modulating said output signal, said modulation including a variable time constant which varies as a function of said oxygen level; and (f) supplying said modulated output signal as the reference voltage of step (c).

3. The system according to claim 1, wherein said control means comprises differentiating means for differentiating said output voltage of said oxygen sensor and logic means for setting said time constant at a relatively small first value when the differential value of the output voltage of said oxygen sensor is within a predetermined range, and for setting said time constant at a relatively large second value when the differential value of said output of said oxygen sensor is outside said predetermined range.

4. The system according to claim 3, wherein said smoothing means comprises an RC circuit having a variable resistance component.

5. The system according to claim 4, wherein said smoothing means comprises a capacitor, a first resistor through which said modulated voltage signal is applied to said capacitor, a second resistor connected in parallel with said first resistor, and a switching means for disconnecting said second resistor from said first resistor when an output of said logic means indicates that said differential value of said output voltage of said oxygen sensor is outside said predetermined range.

6. The system according to claim 1, wherein said judgement means, said modulating means, said smoothing means and said control means are each means for treating analog signals.

7. A system according to claim 1, further comprising a digital microcomputer, said microcomputer comprising said judgement means, said modulating means, said smoothing means and said control means.

8. The method of claim 2, wherein the step of modulating said output signal comprises substracting a fixed voltage from said output signal when the air/fuel ratio signal indicates that the air/fuel ratio is below the stoichiometric ratio and adding a fixed voltage to said output signal when the air/fuel ratio signal indicates that the air/fuel ratio is above the stoichiometric ratio thereby producing a modulated signal.

* * * * *